United States Patent [19]

Stanzel

[11] Patent Number: 4,781,642

[45] Date of Patent: Nov. 1, 1988

[54] ROTARY FLYING TOY

[76] Inventor: Victor Stanzel, P.O. Box 28, Schulenburg, Tex. 78956

[21] Appl. No.: 79,009

[22] Filed: Jul. 29, 1987

[51] Int. Cl.[4] ..... A63H 27/00; A63H 27/12

[52] U.S. Cl. ..... 446/38; 446/45

[58] Field of Search ..... 446/38, 57, 45, 35, 446/36, 37, 39, 40, 41, 44, 46, 58

[56] References Cited

U.S. PATENT DOCUMENTS

| | | | |
|---|---|---|---|
| 951,686 | 3/1910 | Katterjohn | 446/39 |
| 1,294,917 | 2/1919 | Koontz | 446/39 |
| 1,618,856 | 2/1927 | Abrams et al. | 446/39 |
| 2,189,763 | 2/1940 | Schimpfle | 446/39 |
| 2,731,767 | 1/1956 | Holt | 446/38 |
| 3,182,422 | 5/1965 | Ryan | 446/39 X |
| 3,570,467 | 3/1971 | Belokin, Jr. | 446/38 X |
| 3,605,328 | 9/1971 | Kilroy, Jr. | 446/41 |
| 4,108,939 | 1/1980 | Matsushiro | 446/38 |

*Primary Examiner*—Robert A. Hafer
*Assistant Examiner*—D. Neal Muir
*Attorney, Agent, or Firm*—Vinson & Elkins

[57] ABSTRACT

A rotary flying toy is disclosed including a rotor having a plurality of radially extending generally horizontal blades adapted to rotate about the vertical axis of the rotor to provide vertical lift. A separate hand-held launcher is provided and includes an electric motor for accelerating the rotor to a rotational velocity sufficient for the rotor to fly when separated from the launcher. Inclined surfaces act to retain the rotor on the launcher until the desired rotational speed is reached and to eject the rotor from the launcher.

12 Claims, 2 Drawing Sheets

ROTARY FLYING TOY

SUMMARY OF THE INVENTION

This invention relates to an improvement in rotary flying toys of the type in which a rotor with a plurality of generally horizontal propeller-type blades is spun on a launcher until it reaches a rotational velocity at which the blades provide adequate lift for the rotor to fly.

In prior art rotary flying toys, the rotor has been held on the launcher by means of a spindle on the launcher which fit through a hole in the center of the rotor. As soon as the launcher spun the rotor fast enough for the lift imparted by the blades to exceed the weight of the rotor, plus the friction between the spindle and rotor, the rotor would launch automatically. This prevented spinning the rotor to a speed substantially exceeding its launch velocity and therefore limited the height and duration of the rotor flight.

According to an important aspect of the present invention, means are provided for releasably retaining the rotor on the launcher so that the rotor may be sped up further before being launched. This permits additional rotational velocity and rotational momentum to be imparted to the rotor and makes possible a more dramatic, higher and longer lasting flight of the rotor.

According to another important aspect of the invention, ejector means are provided for automatically imparting additional vertical thrust to the rotor to eject it from the launcher at the time the operator of the toy decides to launch the rotor. The ejector means not only rapidly ejects the rotor from the launcher, but also provides an additional upward thrust to improve the flight of the toy.

According to another important aspect of the invention, means are provided for simultaneously disengaging the electric motor of the launcher, disengaging the retaining means holding the rotor on the launcher and engaging the ejector means for launching the rotor into flight.

DESCRIPTION OF THE DRAWINGS

In the accompanying drawings, which form a part of the application and in which like numerals indicate like parts.

DESCRIPTION OF THE PREFERRED EMBODIMENT

Figure 1:
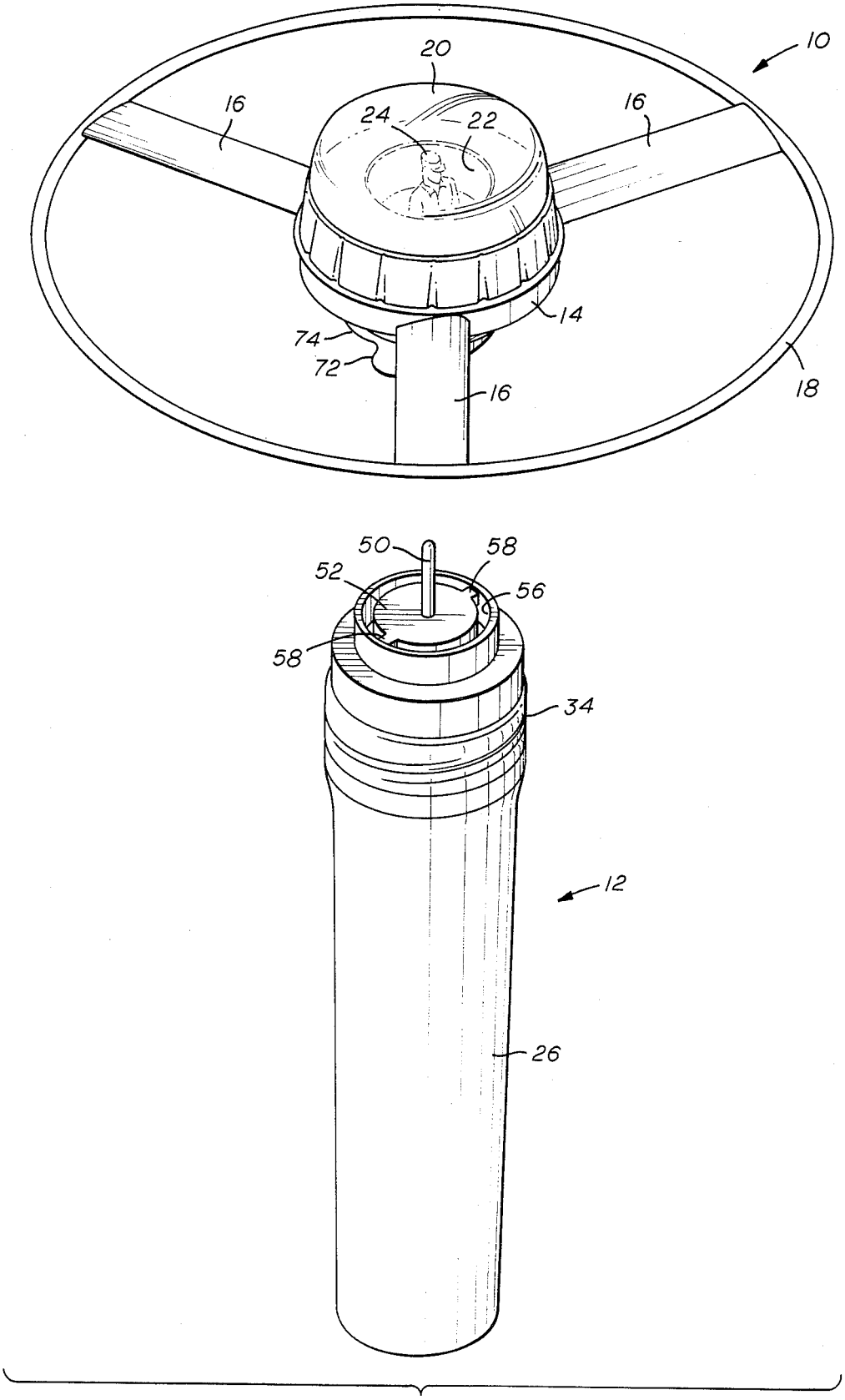
FIG. 1 is a perspective view illustrating the rotor and hand-held launcher of the present invention.
Figure 2:
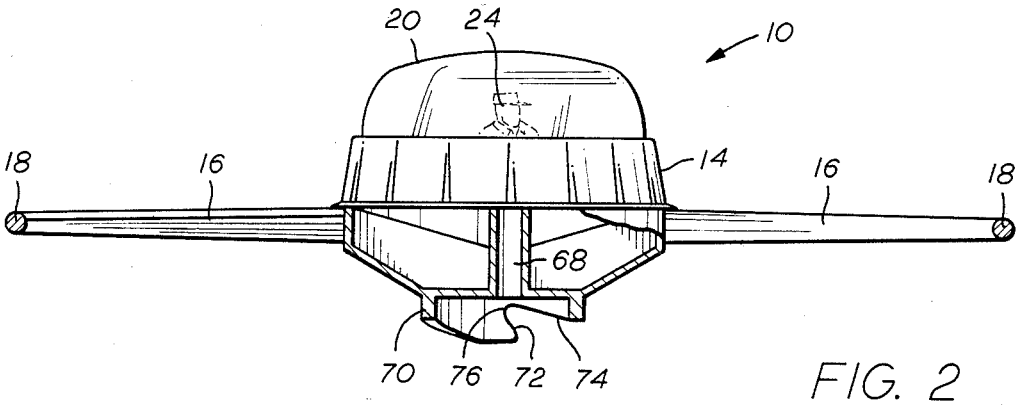
FIG. 2 is a view in vertical elevation, and partly in section, of the rotor of FIG. 1.

Referring out of FIG. 1, there is shown a rotary flying toy including a rotor 10 and a separate hand-held launcher 12. The rotor, which preferably is formed of plastic, includes a central hub 14 with a plurality, preferably three, generally horizontal propeller-type blades 16 extending radially outwardly from the hub. The blades are joined at their outer ends by a circular brace 18. The hub 14 includes a clear plastic dome 20 revealing a central cockpit 22 and three dimensional toy FIG. 24. The rotor 10 thus simulates a flying saucer, or other rotary aircraft, with an operator at the controls.

The three blades 16 extend radially and generally horizontally from the vertical axis of the rotor 10 and have their upper and lower surfaces curved and inclined from the horizontal so that the blades function as horizontal propellers. In the preferred embodiment, the blades have an angle of attack of approximately 14 degrees where they are attached to the central hub 14. When the rotor 10 is rotated in a counterclockwise direction (as viewed in the drawings), the blades 16 will impart vertical lift to the rotor 10 and, at sufficient rotational speed, will enable the rotor 10 to fly.

For the purpose of imparting sufficient rotational velocity to the rotor 10 and launching the rotor 10, there is provided the separate hand-held launcher 12. The launcher includes an elongated cylindrical housing 26, preferably of molded plastic. The outside of the housing 26 functions as a handle for holding the launcher 12.

Inside the housing 26 there is disposed an electrical motor 28 powered by a plurality of flashlight-type batteries 30. The motor 28 is retained in the housing 26 by means of a collar 32 suitably attached to the motor and having its outer edge resting on the top of the housing 26. A screw ring 34, preferably of metal, has formed threads which engage mating threads 36 on the upper outer edge of the housing 26. The screw ring may be screwed onto the housing to retain the batteries and motor in place. With this construction, the screw ring 34, motor 28 and collar 32 may be selectively disengaged from the top of the cylindrical housing 26 for placement and replacement of the batteries 30.

The direct-current electric motor 28 is of conventional construction and its details of construction are disclosed more fully in U.S. Pat. No. 3,018,585. One terminal of the electric motor 28 is electrically connected to the batteries 30 by conducting buttons 38 on the motor and 39 on the batteries. The other motor terminal is adapted for electrical connection to the lower battery case terminal 40 by means of a flexible electric conductor 42 which extends from the lower battery case terminal 40 along the inside of the housing 26. The conductor 42 preferably is made of flexible electrically conductive metal, such as brass, and is fastened to the housing 26 as by rivet 44. The free end of the conductor 42 is angled so that its tip portion 46 is adapted, when depressed by button 48 extending through the housing 26, to engage the electrically conductive outer housing on the electric motor 28, thereby completing the electric circuit and switching on the motor 28. The resilience of the conductor 42 will cause the conductor to return to its retracted position, and break the electric circuit, as soon as the button 48 is released. The motor 28 thus is provided with switch means for selectively operating the electric motor. The switch means is moveable between an off position, in which the tip 46 of conductor 42 is spaced from the housing of the motor 28 so that the electrical circuit is not completed and the motor is not operated, and an on position, in which the tip 46 of the conductor 42 engages the electrically conductive housing of the motor 28, the circuit is completed and the electrical motor 28 is operated. The resiliency of the conductor 42 biases the switch into the off position so that the electrical motor 28 will only operate when the button 48 is held in a depressed position by the toy operator.

The resiliency of the angled lower end of the conductor 42 serves as a spring for retaining the batteries 30 in engagement with each other and in engagement with the motor conducting button 38. Although the housing 26 is illustrated as containing two cylindrical flashlight-type batteries 30, obviously the housing may be made in any desired size and configuration and may contain other batteries if a greater voltage or power is desired for operating the motor 28.

A drive shaft 50 extends from and is powered for rotation about its vertical axis by the electric motor 28. The drive shaft 50 extends through the central bore of a rotary drive plate 52 positioned above the screw ring 34. Splines 54 on the drive shaft 50 are keyed to the rotary drive plate 52 so that the drive plate is suspended from and rotates with the drive shaft 50.

Disposed in the upper surface of the drive plate 52 is a cylindrical groove 56. Two drive lugs 58 extend across the upper portion of the groove at 180° angles from each other. As explained more fully below, the groove 56 and lugs 58 on the drive plate cooperate with mating parts of the rotor 10 to retain, accelerate and launch the rotor into flight.

Brake means are provided in the launcher 12 for selectively rapidly decelerating the rotational velocity of the drive plate 52, drive shaft 50, and the associated motor 28. As explained more fully hereinafter, such brake means are used in launching the rotor into flight. The brake means include a brake pad 60, formed of some high friction material such as rubber. The brake pad 60 is adapted to engage the inner surface of depending flange 62 on the drive plate 52. The brake pad 60 is mounted on an elongated flexible support member 64 which extends downwardly from the brake pad through an opening in the motor collar 32 and is attached to the wall of the launcher housing 26 by rivet 44. The flexible member 64 will move radially within the housing 26, together with the upper end of the flexible conductor 42, as the actuating button 48 is depressed and released. Support member 64 preferably is formed of a strong resilient material, such as steel.

A retaining bracket 66, which is attached to the inside wall of the launcher housing 26 as by adhesive bonding, retains the upper portion of the brake pad support member 64 against angular displacement responsive to braking forces and when the screw ring 34 and drive plate 52 are rotated during placement and replacement of the batteries 30.

Figure 3:
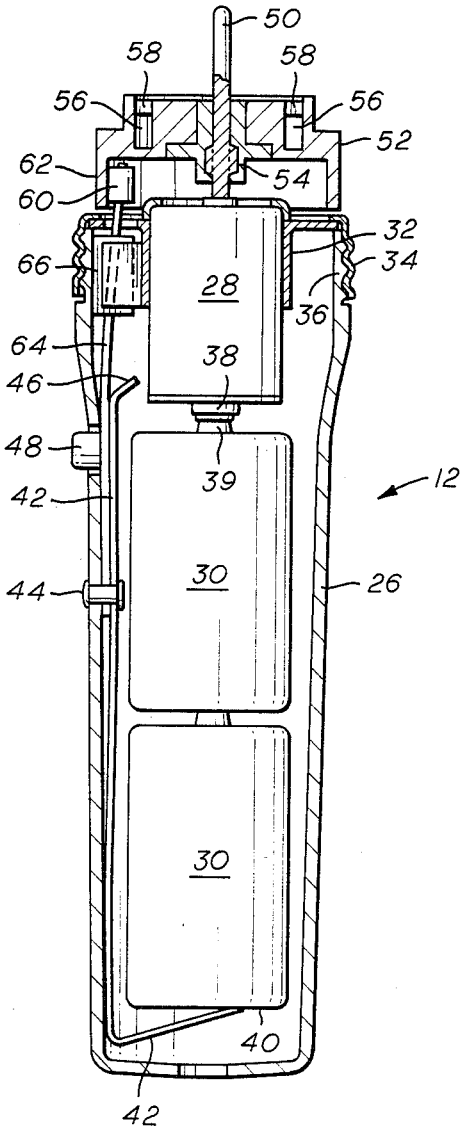
FIG. 3 is a view in elevation, and partly in section, of the hand-held launcher of FIG. 1.

As can be seen from FIG. 3, the natural resiliency of the flexible conductor 42 and of the support member 64 provide resilient means for biasing the brake pad 60 into engagement with the flange 62 on drive plate 52 whenever the actuating button 48 is released. Conversely, as the actuating button 48 is depressed to connect the top 46 of the conductor 42 with the housing of the motor 28, in order to complete the electrical circuit and operate the motor 28, the brake pad 60 automatically will be retracted from engagement with the flange 62, thus permitting the electric motor 28, drive shaft 50 and drive plate 52 to rotate freely.

Means are provided on the rotor 10 for operatively and releasably engaging the rotor with the launcher 12. In the preferred embodiment these include a central bore 68 formed on the underside of the hub 14 for receiving the drive shaft 50 and a depending circular flange 70 on the hub 14 adapted to be received in the circumferential groove 56 of drive plate 52. Opposed first inclined surfaces 72 and second inclined surfaces 74 are formed in the depending flange 70 and meet to form a notch 76. Two such sets of inclined surfaces and notches 76 are provided in the depending flange 70 to cooperate with the two drive lugs 58 on the drive plate 52.

In operation, the rotor 10 is placed on the launcher 12 with the drive shaft 50 being received in the bore 68 on the underside of hub 14. The depending flange 70 is received in the circular groove 56 of drive plate 52 with the two drive lugs 58 being received in the notches 76 formed by the inclined surfaces 72 and 74.

When the button 48 on the launcher is depressed, the top 46 of the conductor 42 is moved into contact with the outer housing of the motor 28, thus completing the electrical circuit and operating the motor 28 to rotate the drive shaft 50 and drive plate 52. Simultaneously, the brake pad 60 is withdrawn from engagement with the flange 62 of the drive plate 52, thus permitting the drive plate and drive shaft to rotate freely responsive to the rotational drive imparted by the motor 28. The drive lugs 58 transmit the rotational motion to the rotor 10, which rotates at the same speed as the motor and drive plate. In the preferred embodiment, as illustrated in the drawings, the rotor 10 rotates in a counterclockwise direction.

As the rotational velocity of the rotor increases, the blades 16 will impart aerodynamic lift to the rotor. When sufficient rotational velocity is reached, the rotor will tend to lift vertically from the launcher 12. However, the first inclined surfaces 72 on the depending flange 70 of the rotor are inclined rearwardly with respect to the direction of rotation of the rotor and will engage the undersides of the drive lugs 58 on the drive plate 52. With the surfaces 72 extending rearwardly below the drive lugs 58, the rotor cannot escape vertically from the launcher without rotating at a velocity greater than that of the drive plate 52. So long as the motor 28 is continuing to accelerate, this condition will not be reached. Therefore, means are provided for selectively retaining the rotor on the launcher as the rotational speed is increased beyond that necessary for the rotor to fly. Retaining the rotor on the launcher as rotational velocity is further increased makes possible faster, higher, longer and more dramatic flights of the rotor, once it is ejected from the launcher, than would otherwise be possible.

When it is decided to eject the rotor from the launcher, the button 48 is released. The resilience of the conductor 42 and elongated brake pad support member 64 will automatically and substantially simultaneously break the electrical connection between the batteries 30 and motor 28, and move the brake pad 60 back into engagement with the inner surface of the depending flange 62 on the drive plate 52. Engagement of the brake pad with the flange will cause rapid deceleration of the drive plate 52, drive shaft 50 and electric motor 28.

As the drive plate 52 is rapidly decelerated relative to the rotor 10, the drive lugs 58 will move rearwardly in the notches 76 and engage the second inclined surfaces 74. This moves the drive lugs 58 out of engagement with the retaining inclined surfaces 72. With continued relative rotation between the rotor 10 and drive plate 52, the lugs 58 will travel along the inclined surfaces 74 to impart additional vertical lift to the rotor 10, causing the rotor 10 to rise vertically out of engagement with the drive lugs 58 and to be launched into flight from the launcher 12. At this point, the rotor 10 will be rotating with more than sufficient rotational velocity for the blades 16 to impart rapid lift to the rotor, causing the rotor to fly rapidly away from the launcher in a generally vertical direction, but with horizontal and arcuate components to the flight path, responsive to the rotational momentum of the rotor. Once the rotational velocity of the rotor has decayed sufficiently in flight, the rotor will descend to the ground where it may be retrieved and placed on the launcher for another flight.

The foregoing disclosure and description of the invention is illustrative and explanatory thereof, and various changes in the size, shape and materials, as well as in the details of the illustrated embodiment, may be made within the scope of the appended claims without departing from the spirit of the invention.

What is claimed is:

1. A rotary flying toy comprising:

a rotor having a vertical axis and a plurality of blades adapted to rotate about said vertical axis of said rotor to provide vertical lift to said rotor;

a hand-held launcher for powering said rotor, said launcher comprising, an electric motor for powering said rotor, a source of electric power, switch means for selectively connecting said power source to said electric motor for operating said electric motor, drive means for selectively engaging said electric motor with said rotor, whereby said electric motor may be operated to spin said rotor about said vertical axis of said rotor at a rotational velocity sufficient for said rotor to fly, means for selectively retaining said rotor on said launcher as the rotational speed of said rotor is increased beyond that necessary for said rotor to fly, brake means for selectively rapidly decelerating said drive means, and resilient means for biasing said switch means into a position where said electric motor is not connected to said source of electric power and for biasing said brake means into a position for decelerating said drive means.

2. The rotary flying toy according to claim 1 additionally comprising ejector means adapted to provide additional vertical lift to said rotor to eject said rotor from said launcher when said drive means is rapidly decelerated by said brake means.

3. The rotary flying toy according to claim 1 wherein said rotor comprises a central hub, a plurality of generally horizontal blades extending radially from said hub and a circular brace joining the outer ends of said blades.

4. The rotary flying toy according to claim 1 wherein said drive means for selectively engaging said electric motor with said rotor comprises a rotary drive plate on said launcher connected to and driven for rotation by said electric motor, said drive plate having a circular groove and a plurality of drive lugs disposed in said groove, said groove and said drive lugs being adapted to cooperate with mating portions of said rotor.

5. The rotary flying toy according to claim 4 wherein said rotor comprises additionally a depending circular flange adapted to be received within said circular groove of said drive plate, said flange having formed therein a plurality of notches for releasable engagement with said drive lugs.

6. The apparatus according to claim 5 wherein said means for selectively retaining said rotor on said launcher comprise first inclined surfaces on said depending flange adjacent said notches and adapted to engage the bottoms of said drive lugs.

7. The rotary flying toy according to claim 5 wherein said rotor additionally comprises second inclined surfaces on said depending flange of said rotor adjacent said notches, said drive lugs being adapted to engage and travel along said second inclined surfaces to eject said rotor from said launcher when said drive plate is rapidly decelerated relative to said rotor.

8. A rotary flying toy comprising:

a rotor having a vertical axis and a plurality of blades adapted to rotate about said vertical axis of said rotor to provide vertical lift to said rotor;

a hand-held launcher for powering said rotor, said launcher comprising, an electric motor, a source of electric power, switch means for selectively connecting said power source to said electric motor for selectively operating said electric motor, said switch means being moveable between an off position in which said motor is not operated and an on position in which said motor is operated, a drive plate having a vertical axis and powered for rotation about said vertical axis by said electric motor when said electric motor is operated, means for selectively engaging said drive plate with said rotor, brake means for selectively engaging and rapidly decelerating said drive plate, said brake means being moveable between engaged and disengaged positions, resilient biasing means for biasing said switch means into said off position and for biasing said brake means into said engaged position, and ejector means adapted, upon engagement of said brake means, to provide an additional component of vertical lift to launch said rotor from said hand-held launcher.

9. The apparatus according to claim 8 additionally comprising a depending circular flange on said rotor, said flange having a plurality of notches therein, a circular groove in said drive plate, said circular groove being adapted to receive said depending flange, and a plurality of drive lugs on said drive plate adapted to operatively engage said notches in said depending flange of said rotor, whereby said rotor may be rotated with said drive plate.

10. The apparatus according to claim 9 wherein said ejector means comprise a plurality of inclined surfaces on said depending flange of said rotor adjacent said notches and adapted to cooperate with said drive lugs on said drive plate to impart an additional component of vertical lift to said rotor when said drive plate is rapidly decelerated relative to said rotor upon engagement of said brake means.

11. The rotary flying toy according to claim 8 additionally comprising retainer means for selectively retaining said rotor on said launcher as the rotational speed of said rotor is increased beyond that necessary for the rotor to fly.

12. The apparatus according to claim 8 additionally comprising means for automatically disengaging said brake means when said switch means is in said on position.

* * * * *